US008418975B1

(12) United States Patent
Burr

(10) Patent No.: US 8,418,975 B1
(45) Date of Patent: Apr. 16, 2013

(54) CURTAIN ROD BRACKET ASSEMBLY

(76) Inventor: Thomas M. Burr, Cumberland, RI (US)

( * ) Notice: Subject to any disclaimer, the term of this patent is extended or adjusted under 35 U.S.C. 154(b) by 14 days.

(21) Appl. No.: 13/317,398

(22) Filed: Oct. 17, 2011

Related U.S. Application Data

(60) Provisional application No. 61/417,622, filed on Nov. 29, 2010.

(51) Int. Cl.
*A47H 1/10* (2006.01)

(52) U.S. Cl.
USPC ..... 248/261

(58) Field of Classification Search ..... 248/201, 248/261, 262, 263, 264
See application file for complete search history.

(56) References Cited

U.S. PATENT DOCUMENTS

| | | | | |
|---|---|---|---|---|
| D47,004 | S | 2/1915 | Martin | |
| D55,157 | S | 5/1920 | Dubish | |
| 1,525,895 | A * | 2/1925 | Sherwood | 248/254 |
| D242,986 | S | 1/1977 | Inglis | |
| D253,162 | S | 10/1979 | Sheehan | |
| 4,684,095 | A * | 8/1987 | Athey | 248/255 |
| 5,398,900 | A * | 3/1995 | Schober | 248/251 |
| D389,035 | S | 1/1998 | Smiley et al. | |
| D408,722 | S | 4/1999 | Sartini | |
| D420,567 | S | 2/2000 | Laga et al. | |
| D455,334 | S | 4/2002 | Ivankovic | |
| D464,013 | S | 10/2002 | Adams et al. | |
| D478,804 | S | 8/2003 | Titus | |
| D602,344 | S | 10/2009 | Olien | |
| D611,328 | S | 3/2010 | Hanley et al. | |
| 8,231,093 | B2 * | 7/2012 | Tran | 248/262 |
| 2010/0224749 | A1 * | 9/2010 | Tran | 248/262 |

* cited by examiner

*Primary Examiner* — Ramon Ramirez

(57) ABSTRACT

A bracket assembly is disclosed which includes an integrated first and second "L" shaped bracket for attachment to a window molding. The first bracket includes a substantially horizontal mounting plate and orthogonally disposed side member. A plurality of mounting pins are integrally disposed on the first bracket horizontal mounting plate for engagement into the top of a window molding. One side of the orthogonally disposed side member rests against the side of the molding. The opposite side of the orthogonally disposed side member includes a second "L" shaped bracket attached thereto having an outward projecting support bar for engagement of one end of a curtain rod. The second "L" shaped bracket further includes a rear brace flush with the mounting surface wall, orthoganally disposed in relation to the support bar, and affixed at its side edge to the opposite side of the first bracket orthogonally disposed side member.

6 Claims, 3 Drawing Sheets

CURTAIN ROD BRACKET ASSEMBLY

CROSS-REFERENCE TO RELATED APPLICATIONS

This application claims the benefit of U.S. Provisional Application No. 61/417,622, filed Nov. 29, 2010.

FIELD OF THE INVENTION

The apparatus of the present invention relates to curtain rods. More particularly, the present invention relates to an apparatus which is attachable to the corner of a window molding without the use of mounting nails or screws, which will accommodate a curtain rod thereupon after the bracket has been placed into position.

BACKGROUND OF THE INVENTION

Brackets have long been used for mounting curtain rods, shower curtain rods, and other rods to surfaces such as walls, windows, window frames, window casings, and ceilings. These brackets are offered in many different shapes and sizes and range from highly ornamental designs to simpler utilitarian designs. Often, these brackets comprise a hook-like feature in which the rod rests, or a ring through which the rod passes. In some commercial embodiments, the rod is allowed to freely rotate and slide back and forth on the bracket. In other commercial embodiments, the rod is secured by the user screwing a thumb screw through the bracket until it contacts the outer surface of the rod.

A problem in utilizing brackets of such known construction is that nails or screws cause holes in the front face of the molding and after several repositionings, as may be required over the years, the molding may become honeycombed or even split. This makes it increasingly difficult to mount new pairs of curtains, draperies, or the like on to the molding.

It is accordingly an object of the present invention to provide a bracket which when used to support curtain rods and the like on wooden and other moldings does not require screws or nails for such attachment to the molding. Rather, the bracket includes a plurality of integrally mounted pins which secure the bracket along the top of a molding, leaving any holes out of view when and if the bracket is subsequently removed.

Furthermore, the present inventions two piece construction alleviates load support problems inherent to brackets having heavy curtains displaced along the surface of a supported curtain rod.

SUMMARY OF THE INVENTION

The bracket assembly according to the present invention includes an integrated first and second "L" shaped bracket. The first bracket includes a substantially horizontal mounting plate and orthogonally disposed side member. A plurality of mounting pins are integrally disposed on the first bracket horizontal mounting plate for engagement into the top of a window molding. One side of the orthogonally disposed side member rests against the side of the molding. The opposite side of the orthogonally disposed side member includes a second "L" shaped bracket attached thereto having an outward projecting support bar for engagement of one end of a curtain rod. The second "L" shaped bracket further includes a rear brace flush with the mounting surface wall, orthoganally disposed in relation to the support bar, and affixed at its side edge to the opposite side of the first bracket orthogonally disposed side member.

BRIEF DESCRIPTION OF THE DRAWINGS

The invention is best understood from the following detailed description when read in connection with the accompanying drawings, which illustrate various embodiments of the present invention.

Figure 1:
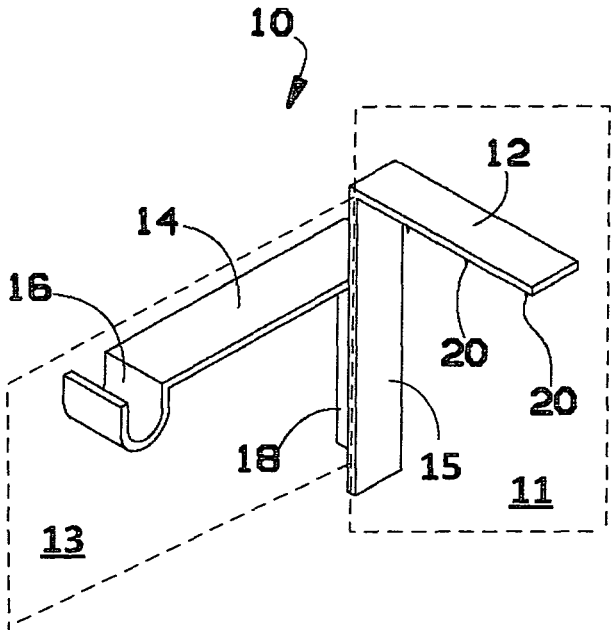
FIG. 1 illustrates a perspective view of a curtain rod bracket assembly according to an exemplary embodiment of the present invention.
Figure 2:
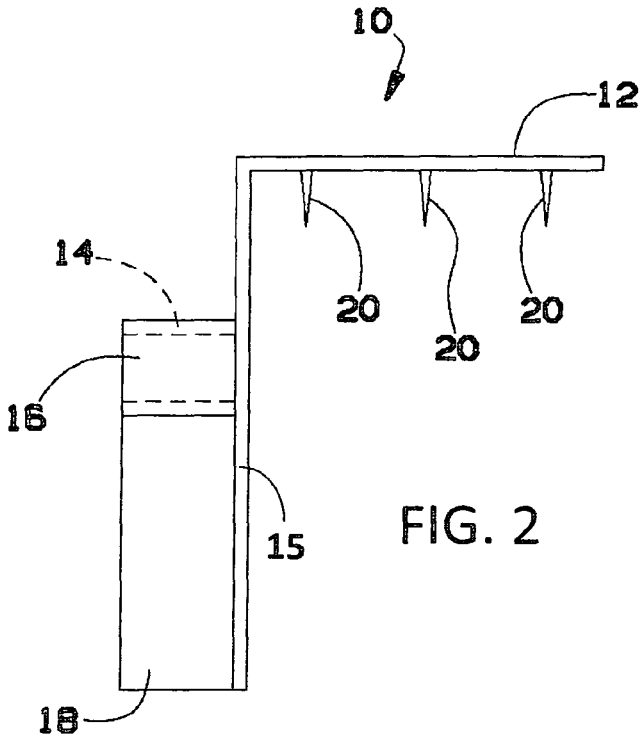
FIG. 2 is a front view of the Curtain Rod Bracket Assembly of FIG. 1.
Figure 3:
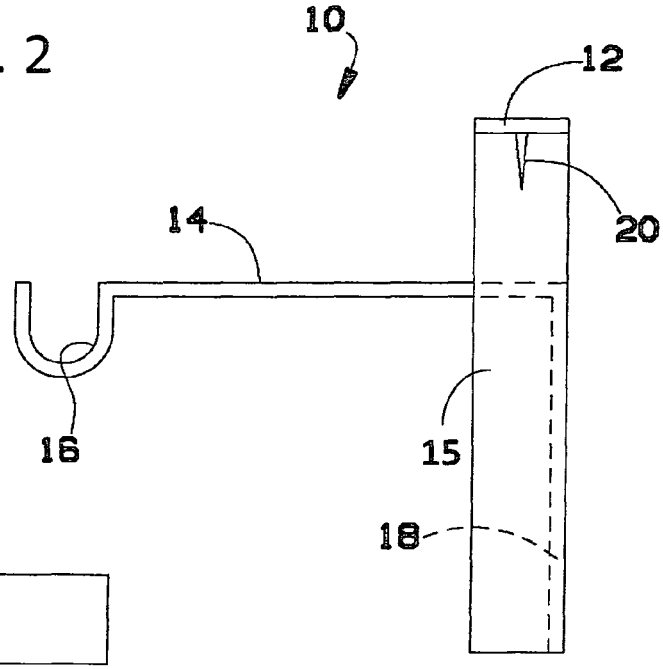
FIG. 3 is a side view of the Curtain Rod Bracket Assembly of FIG. 1.
Figure 4:
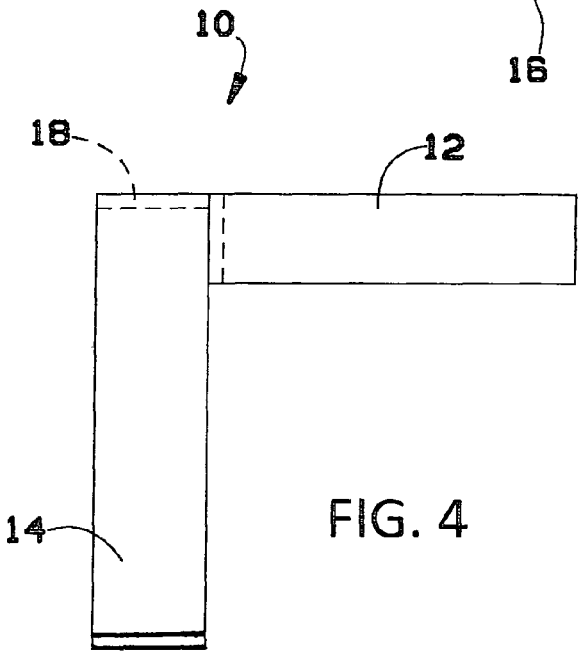
FIG. 4 is a top view of the Curtain Rod Bracket Assembly of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is defined by the appended claims. Broadly, the scope of the present invention generally encompasses a curtain rod bracket assembly utilizing a dual "L" shaped bracket structure that provides increased load bearing capability and eliminates the need for screws or nails.

DETAILED DESCRIPTION OF THE INVENTION

Referring now to FIGS. 1-6, different views of a curtain rod bracket assembly 10 are shown according to an exemplary embodiment of the present invention. "Bracket Assembly" is interchangeably used for "Curtain Rod Bracket Assembly" throughout the specification. The bracket assembly 10 may include a first bracket 11 and a second bracket 13. In the preferred embodiment, both brackets 11 and 13 may be "L" shaped.

The first bracket 11 may include a substantially horizontally oriented mounted plate 12 and an orthogonally disposed side member 15. A plurality of engagement protrusions 20, such as mounting pins or the like, may be attached on an inward facing side of the mounting plate 12. The second bracket 13 may include a support bar 14 extending substantially horizontally from an orthogonally disposed rear brace 18. A support cup 16 may be attached to support bar 14, to accept and to support a curtain rod 26 and curtains 24. The support cup 16 may be made with various diameters depending on the diameter of curtain rod 26.

The first and second brackets 11 and 13 may be arranged as such that they offset from each other by a 90 degree angle. In the preferred embodiment, support bar 14 of second bracket

13 is positioned lower than mounting plate 12 of first bracket 11 to facilitate the curtain rod 26 hanging below the top of the window molding.

Figure 5:
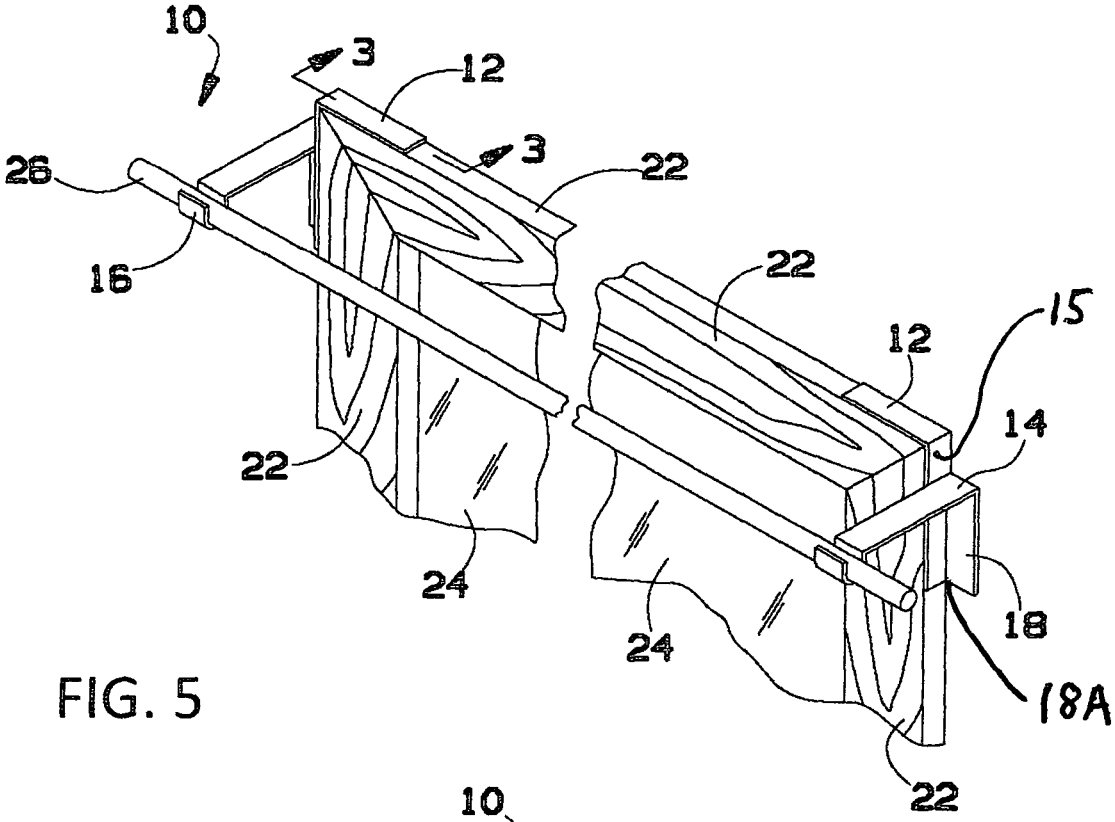
FIG. 5 is a perspective view of the Curtain Rod Bracket Assembly in use.
Figure 6:
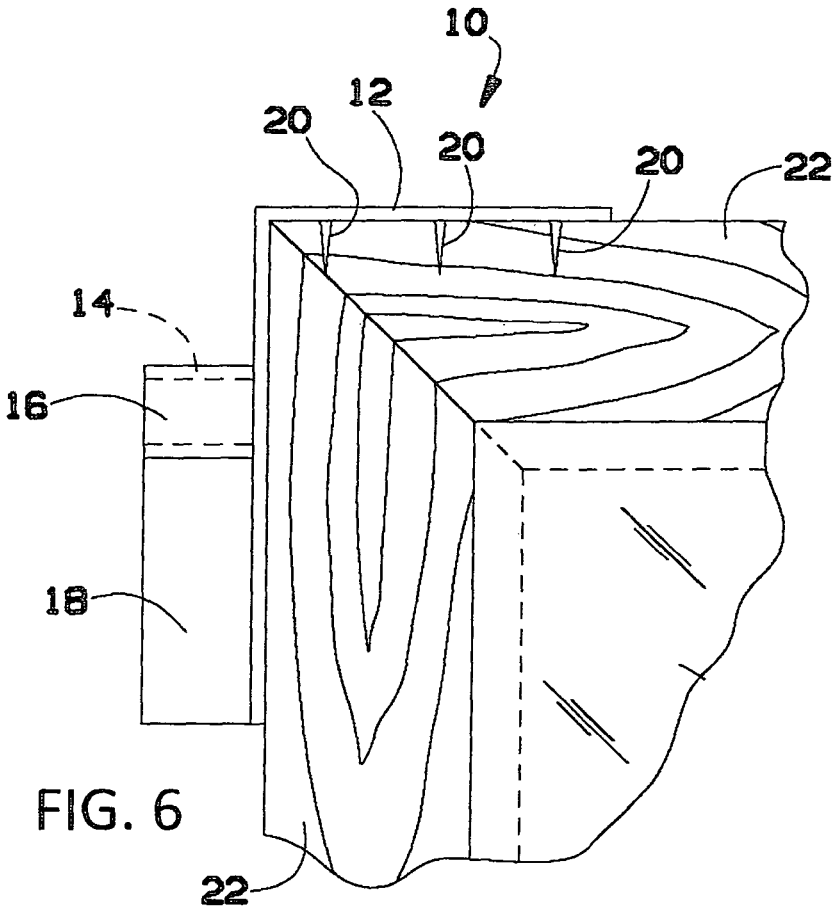
FIG. 6 is a detailed section view of the Curtain Rod Bracket Assembly taken along line 3-3 of FIG. 5.

A side edge 18A of the rear brace 18 may be affixed to an outside face of the first bracket 11 side member 15. In the preferred embodiment, the outside face of the rear brace 18 may be in flush with a back edge of the first bracket 11, side member 15, at side edge 18A as illustrated in FIG. 5. Furthermore, in the preferred embodiment, the portion of the support bar 14 that contacts sidemember 15 may be affixed to sidemember 15 for increased rigidity of bracket assembly 10.

The first bracket 11 of the bracket assembly 10 may be fitted over a corner of a window molding 22 and when the bracket assembly is pressed downward, the mounting pins 20 may penetrate the window molding 22 to hold the bracket assembly 10 firmly into place. When the curtain rod 26 and the curtain 24 are placed on the support cups 16, their weights may be transferred along the support bar 14 back to both sidemember 15 and the rear brace 18.

Since rear brace 18 is flush against the wall any bending will be counteracted by the wall. As the bracket assembly 10 is being pulled downward and forward, the mounting pins 20, engaged to the window molding 22, may prevent any slippage and may further stabilize the bracket assembly 10.

The bracket assembly 10 may be made from sheet metal by general metal fabrication processes, for example, stamping, laser cutting, bending and spot welding.

It should be understood that the preceding is merely a detailed description of one embodiment of this invention and that numerous changes to the disclosed embodiment can be made in accordance with the disclosure herein without departing from the spirit or scope of the invention. Rather, the scope of the invention is to be determined only by the appended claims and their equivalents.

I claim:

1. A Curtain Rod Bracket Assembly, comprising:

A first bracket, said first bracket having a substantially horizontal extending mounting plate and a substantially orthogonal side member, said side member extending from one end of said mounting plate;

A second bracket, said second bracket having a substantially horizontal extending support bar and a substantially orthogonal rear brace, said rear brace extending from one end of said support bar, said first and second brackets offset 90 degrees; and wherein said mounting plate includes a plurality of engagement protrusions.

2. A Curtain Rod Bracket Assembly as in claim 1, wherein said support bar further includes a support cup for securing a curtain rod therein, said support cup disposed at the opposite end of said support bar.

3. A Curtain Rod Bracket Assembly as in claim 1, wherein said extending support bar is positioned lower than said extending mounting plate.

4. A Curtain Rod Bracket Assembly as in claim 1, wherein said rear brace is affixed to said side member, said rear brace and said side member offset by 90 degrees.

5. A Curtain Rod Bracket Assembly as in claim 4, wherein said rear brace is affixed to said side member at said rear brace side edge.

6. A Curtain Rod Bracket Assembly as in claim 5, wherein a portion of said extending support bar is affixed to said side member.

* * * * *